US011618651B2

(12) United States Patent
Chaudhry et al.

(10) Patent No.: US 11,618,651 B2
(45) Date of Patent: Apr. 4, 2023

(54) DOUBLE DECK ELEVATOR WITH LINEAR ACTUATOR ADJUSTMENT MECHANISM

(71) Applicant: OTIS ELEVATOR COMPANY, Farmington, CT (US)

(72) Inventors: Zaffir A. Chaudhry, South Glastonbury, CT (US); Enrico Manes, Feeding Hills, MA (US); Walter Thomas Schmidt, Marlborough, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 17/404,207

(22) Filed: Aug. 17, 2021

(65) Prior Publication Data

US 2021/0371246 A1 Dec. 2, 2021

Related U.S. Application Data

(62) Division of application No. 15/871,220, filed on Jan. 15, 2018, now Pat. No. 11,117,786.

(51) Int. Cl.
*B66B 11/02* (2006.01)
*B66F 7/06* (2006.01)

(52) U.S. Cl.
CPC ..... *B66B 11/022* (2013.01); *B66F 7/0666* (2013.01)

(58) Field of Classification Search
CPC ... B66B 11/022; B66B 11/0213; B66F 7/0666
See application file for complete search history.

(56) References Cited

U.S. PATENT DOCUMENTS 1,634,854 A * 7/1927 Scollard ..... B66B 9/022 187/270
4,867,277 A * 9/1989 Sloan ..... B66F 11/042 D34/24

(Continued)

FOREIGN PATENT DOCUMENTS

EP 1074503 A2 2/2001
JP 2000211857 8/2000

(Continued)

OTHER PUBLICATIONS

Toshiba Elevator and Building Systems Corporation, Double Deck Elevator with Adjustable Floor Height in Roppongi Hills, Tokyo, https://www.toshiba-elevator.co.jp/elv/infoeng/technology/doubledeck/ Nov. 28, 2017.

(Continued)

*Primary Examiner* — Michael A Riegelman
(74) *Attorney, Agent, or Firm* — Carlson, Gaskey & Olds, P.C.

(57) ABSTRACT

An illustrative example elevator assembly includes a header beam and a first elevator cab supported by the header beam. A plurality of vertically oriented rods extend beneath the first elevator cab. A horizontally oriented mid-beam is coupled to a first one of the rods near a first end of the mid-beam and coupled to a second one of the rods near a second end of the mid-beam. A second elevator cab is situated beneath the first elevator cab and beneath the mid-beam. At least one linear actuator is supported at least partially on the mid-beam. The linear actuator selectively causes vertical movement of the second elevator cab relative to the rods.

12 Claims, 2 Drawing Sheets

(56) References Cited

U.S. PATENT DOCUMENTS

| | | | | |
|---|---|---|---|---|
| 5,558,181 | A * | 9/1996 | Bundo | B66B 9/022 187/270 |
| 5,907,136 | A * | 5/1999 | Hongo | B66B 11/0095 187/277 |
| 6,336,522 | B1 * | 1/2002 | Fujita | B66B 1/425 187/293 |
| 6,345,547 | B1 * | 2/2002 | Stoelinga | A47B 9/06 74/89.17 |
| 6,802,396 | B2 * | 10/2004 | Naitoh | B66B 1/42 187/401 |
| 7,017,714 | B2 * | 3/2006 | Fujita | B66B 1/425 187/401 |
| 7,090,056 | B2 * | 8/2006 | Fujita | B66B 1/42 187/293 |
| 9,102,502 | B2 * | 8/2015 | Yamada | B66B 11/022 |
| 9,783,391 | B2 * | 10/2017 | Zerelles | B66B 11/022 |
| 10,329,122 | B1 * | 6/2019 | Schmidt | B66B 9/00 |
| 2003/0024772 | A1 * | 2/2003 | Naitoh | B66B 11/0095 187/401 |
| 2004/0238287 | A1 * | 12/2004 | Fujita | B66B 1/425 187/296 |
| 2005/0167207 | A1 * | 8/2005 | Fujita | B66B 11/022 187/401 |
| 2005/0217941 | A1 * | 10/2005 | Strebel | B66B 11/022 187/249 |
| 2007/0137944 | A1 * | 6/2007 | Lam | A61G 3/063 187/267 |
| 2012/0111671 | A1 * | 5/2012 | Yamada | B66F 7/0666 187/249 |
| 2016/0244299 | A1 * | 8/2016 | Zerelles | B66B 9/00 |
| 2019/0218064 | A1 * | 7/2019 | Chaudhry | B66B 11/022 |
| 2019/0218065 | A1 * | 7/2019 | Chaudhry | B66B 11/022 |
| 2019/0218067 | A1 * | 7/2019 | Schmidt | B66B 11/022 |

FOREIGN PATENT DOCUMENTS

| | | | |
|---|---|---|---|
| JP | 2001048447 | A | 2/2001 |
| JP | 2001226048 | | 8/2001 |
| JP | 2001233572 | | 8/2001 |
| JP | 2002087716 | A | 3/2002 |
| JP | 2002362858 | A | 12/2002 |
| JP | 2004277117 | A | 10/2004 |
| JP | 2004307158 | A | 11/2004 |
| JP | 2005089093 | A | 4/2005 |
| JP | 2007055799 | A | 3/2007 |
| WO | 2011/082899 | A1 | 7/2011 |

OTHER PUBLICATIONS

Office action dated Apr. 28, 2020 pertaining to corresponding Chinese Application No. 201910035717.2.

* cited by examiner

DOUBLE DECK ELEVATOR WITH LINEAR ACTUATOR ADJUSTMENT MECHANISM

CROSS REFERENCE TO RELATED APPLICATIONS

This application is a divisional of U.S. patent application Ser. No. 15/871,220 filed on Jan. 15, 2018.

BACKGROUND

Elevator systems have proven useful for carrying passengers among various levels of buildings. Different building types present different challenges for providing adequate elevator service. Larger buildings that are more populated typically require increased elevator system capacity, especially at peak travel times. Different approaches have been suggested for increasing elevator system capacity.

One approach includes increasing the number of shafts or hoistways and elevator cars. This approach is limited because of the increased amount of building space required for each additional elevator. Another proposal has been to include more than one elevator car in each hoistway. Such arrangements have the advantage of increasing the number of cars without necessarily increasing the number of hoistways in a building. One of the challenges associated with systems having multiple cars in a single hoistway is maintaining adequate spacing between the cars and ensuring that they do not interfere with each other.

Another suggested approach has been to utilize a double deck elevator car in which two cabs are supported on a single frame in a manner that they both move in the elevator hoistway together. In some versions, the cabs can move relative to each other within the frame to adjust spacing between the cabs. Double deck elevators typically have heavier cars that require larger or more ropes, larger counterweights and larger motors. Each of these undesirably increases the cost of the system.

SUMMARY

An illustrative example elevator assembly includes a header beam and a first elevator cab supported by the header beam. A plurality of vertically oriented rods extend beneath the first elevator cab. A horizontally oriented mid-beam is coupled to a first one of the rods near a first end of the mid-beam and coupled to a second one of the rods near a second end of the mid-beam. A second elevator cab is situated beneath the first elevator cab and beneath the mid-beam. At least one linear actuator is supported at least partially on the mid-beam. The linear actuator selectively causes vertical movement of the second elevator cab relative to the rods.

In an example embodiment having one or more features of the elevator assembly of the previous paragraph, the at least one linear actuator comprises at least one rotatable shaft aligned with the mid-beam.

In an example embodiment having one or more features of the elevator assembly of any of the previous paragraphs, the at least one linear actuator comprises at least one of a worm gear device, a ball screw device, a roller screw device, a lead screw device, and a jack screw device.

In an example embodiment having one or more features of the elevator assembly of any of the previous paragraphs, the rods are threaded. The second elevator cab includes a plurality of nuts secured in a fixed position relative to the second elevator cab. The plurality of nuts are received on the rods. The at least one linear actuator selectively causes rotation of the rods to cause the vertical movement of the second elevator cab relative to the rods.

In an example embodiment having one or more features of the elevator assembly of any of the previous paragraphs, a load of the second elevator cab is supported by the rods.

In an example embodiment having one or more features of the elevator assembly of any of the previous paragraphs, the first elevator cab includes a plurality of rod supports secured in a fixed position relative to the first elevator cab and the rods are supported by the rod supports to allow rotation of the rods relative to the first elevator cab.

In an example embodiment having one or more features of the elevator assembly of any of the previous paragraphs, the rod supports comprise nuts and the rods move vertically relative to the first elevator cab as the rods rotate.

In an example embodiment having one or more features of the elevator assembly of any of the previous paragraphs, the at least one linear actuator comprises at least one rotatable shaft aligned with the mid-beam. The at least one linear actuator comprises at least one gear that translates rotation of the at least one rotatable shaft into rotation of the rods.

In an example embodiment having one or more features of the elevator assembly of any of the previous paragraphs, the at least one gear is supported on the mid-beam.

In an example embodiment having one or more features of the elevator assembly of any of the previous paragraphs, a pantograph linkage is coupled to the first elevator cab and the second elevator cab. The at least one linear actuator selectively causes expansion or contraction of the pantograph linkage to cause a change in a distance between the first elevator cab and the second elevator cab.

In an example embodiment having one or more features of the elevator assembly of any of the previous paragraphs, a load of the second elevator cab is supported by the pantograph linkage. The rods respectively comprise a stop surface near a bottom of the rod. The second elevator cab includes a plurality of catches. The catches are situated to contact respective stop surfaces when the second elevator cab moves a predetermined distance beneath the first elevator cab.

In an example embodiment having one or more features of the elevator assembly of any of the previous paragraphs, the pantograph linkage comprises a plurality of links and a plurality of pivots that allow the links to move relative to each other. The at least one linear actuator includes at least one rotatable shaft aligned with the mid-beam. At least two of the links or at least two of the pivots are operatively engaged with the shaft. Rotary movement of the shaft causes the links to move relative to each other. Movement of the links relative to each other causes the second elevator cab to move vertically relative to the first elevator cab.

In an example embodiment having one or more features of the elevator assembly of any of the previous paragraphs, the rods remain in a fixed position relative to the first elevator cab. The second elevator cab is configured to move relative to the rods during vertical movement of the second elevator cab relative to the first elevator cab.

In an example embodiment having one or more features of the elevator assembly of any of the previous paragraphs, a roping arrangement is secured to the header beam. The second elevator cab is suspended beneath the first elevator cab and the roping arrangement is configured to support a load of the first elevator cab and a load of the second elevator cab.

The various features and advantages of at least one disclosed example embodiment will become apparent to those skilled in the art from the following detailed description. The drawings that accompany the detailed description can be briefly described as follows.

DETAILED DESCRIPTION

Figure 1:
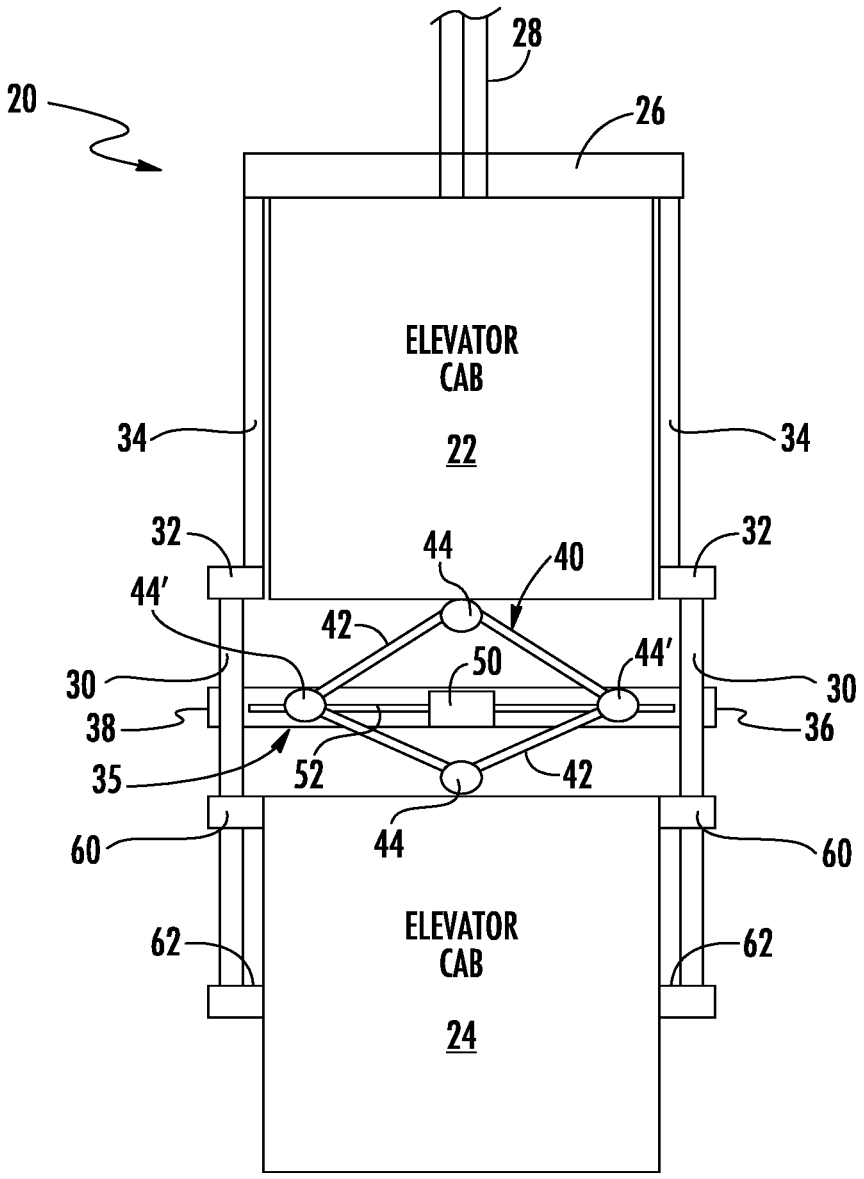
FIG. 1 schematically illustrates selected portions of an elevator system designed according to an embodiment of this invention.

FIG. 1 schematically shows an elevator assembly 20 including a first elevator cab 22 and a second elevator cab 24 in a double deck elevator arrangement. A header beam 26 is connected with roping 28, which may comprise round ropes or flat belts, for example. The first elevator cab 22 is supported by the header beam 26 and roping 28 supports a load of the first elevator cab 22 and the second elevator cab 24. The elevator cabs 22 and 24 move together in a hoistway (not illustrated) based on movement of the roping 28 as caused by a machine (not illustrated).

A plurality of rods 30 extend beneath the first elevator cab 22. In the illustrated example, the rods 30 are secured by frame members 32, such as brackets. The frame members 32 are secured to side frame members 34, which are secured to the header beam 26. The header beam 26 and the side frame members 34 are part of a standard single-cab elevator frame in one embodiment.

The assembly 20 includes a mid-beam 35 situated beneath the elevator cab 22 in a horizontal orientation. The mid-beam 35 is coupled to the rods 30 with one of the rods 30 near a first end 36 of the mid-beam 35 and another rod 30 near a second end 38 of the mid-beam 35. In this embodiment, the rods 30 and the mid-beam 35 remain in a fixed position relative to the first elevator cab 22.

The second elevator cab 24 is suspended beneath the first elevator cab 22 by a pantograph linkage 40 that includes links 42 and pivots 44. The links 42 are able to move relative to each other into different relative positions to contract or expand the pantograph linkage 40 in a vertical direction.

A linear actuator device 50 is at least partially supported on the mid-beam 35. The linear actuator device 50 includes a shaft 52 that is aligned with the mid-beam 35. At least two of the pivots 44' are configured as nuts that follow along a threaded exterior of the shaft 52. The linear actuator 50 includes a motor for rotating the shaft 52 to cause movement of the pivots 44 and the links 42 into different relative positions. Rotary movement of the shaft 52 changes the vertical position of the second elevator cab 24 relative to the first elevator cab 22.

The second elevator cab 24 includes followers 60 that follow along the rods 30 to guide vertical movement of the second elevator cab 24 during an adjustment of the position of the elevator cab 24 relative to the first elevator cab 22.

The rods 30 in this example include stop surfaces 62 near a lower end of the rods 30. The followers 60 contact the stop surfaces 62 to prevent further movement of the second elevator cab 24 in a downward direction. In some embodiments, the stop surfaces 62 are situated beneath a lowest position of the second elevator cab 24 that is permitted by a furthest expansion of the pantograph linkage 40. The stop surfaces 62 in such an embodiment provide a back-up stop to prevent the second elevator cab 24 from descending further than desired relative to the first elevator cab 22. In other embodiments, the position of a stop surface 62 corresponds to a position of the followers 60 when the elevator cab 24 is in the lowest desired position relative to the first elevator cab 22.

Figure 2:
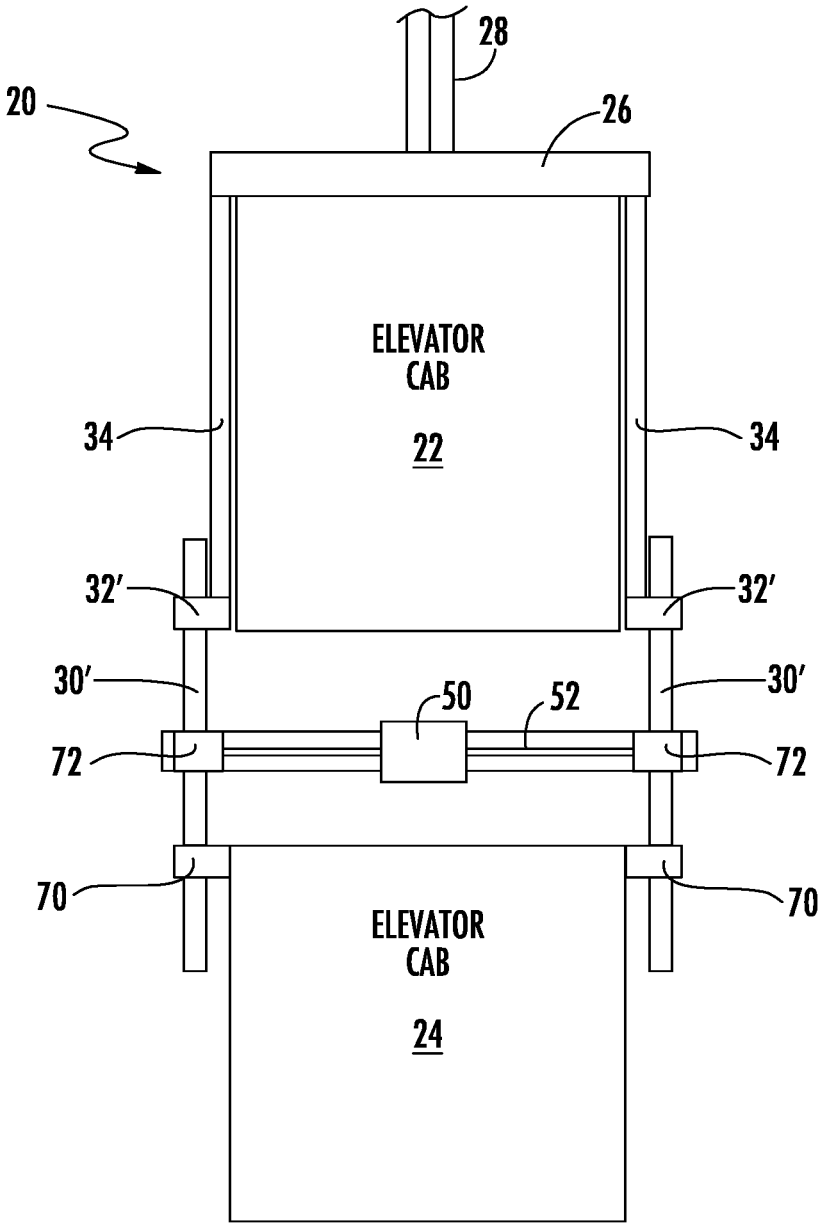
FIG. 2 schematically illustrates selected portions of another example embodiment.

FIG. 2 schematically illustrates another example embodiment including rods 30' extending beneath the first elevator cab 22. In this example, the rods 30' have a threaded exterior. The frame members 32' in this example permit rotation of the rods 30' relative to the first elevator cab 22. In some embodiments, the frame members 32' are configured as nuts that allow the rods 30' to move vertically relative to the first elevator cab 22 as the rods 30' rotate relative to the nuts of the frame members 32'. In other embodiments, the rods 30' remain in a fixed vertical position relative to the first elevator cab 22.

The followers 70 of the second elevator cab 24 in this example are configured as nuts that move along the rods 30' responsive to rotation of the rods 30'. Gears 72 are associated with the shaft 52 of the linear actuator 50 to translate rotary motion of the shaft 52, which is in a horizontal orientation, into rotary motion of the rods 30', which are in a vertical orientation. In one example embodiment, the linear actuator 50 and gears 72 comprise a worm gear device. When the spacing between the first elevator cab 22 and the second elevator cab 24 should be changed, the linear actuator 50 causes the shaft 52 to rotate resulting in the rods 30' rotating. As the followers 70 move up or down the rods 30', the spacing between the elevator cabs changes. The followers 70 may be configured as a ball screw or roller screw nut, for example.

The linear actuators in the example embodiments may comprise a worm gear device as mentioned above. In such embodiments, the linear actuator 50 includes a worm gear device and the followers 70 comprise a worm gear or worm wheel. Other example linear actuators useful in embodiments of this invention include ball screw devices, roller screw devices, lead screw devices and jack screw devices. Those skilled in the art who have the benefit of this description will be able to select an appropriate linear actuator to meet their particular needs.

One feature of the example embodiments is that the double deck elevator car does not require a large outer frame supporting both of the elevator cabs 22, 24. Instead, the second elevator cab 24 is suspended beneath the first elevator cab 22 and the rods 30, 30' guide vertical movement of the elevator cab 24 relative to the first elevator cab 22 to adjust the spacing between them. In the example of FIG. 2, the rods 30' also serve as the support for suspending the load of the second elevator cab 24 beneath the first elevator cab 22. Eliminating the typical large double deck frame significantly reduces the weight of the assembly 20. Weight reductions are highly desirable for double deck elevator systems to avoid the need for larger and more expensive machines, roping arrangements and counterweighs.

The illustrated example embodiments provide cost and space saving improvements by reducing the mass of the assembly 20. Without a large outer frame, the elevator cabs 22, 24 also are able to occupy more of the space within the hoistway, which increases the passenger-carrying capacity of the elevator system.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. An elevator assembly, comprising:

a header beam;

a first elevator cab supported by the header beam;

a plurality of vertically oriented rods extending beneath the first elevator cab;

a horizontally oriented mid-beam coupled to a first one of the rods near a first end of the mid-beam and coupled to a second one of the rods near a second end of the mid-beam;

a second elevator cab situated beneath the first elevator cab and beneath the mid-beam;

at least one linear actuator supported at least partially on the mid-beam, the linear actuator selectively causing vertical movement of the second elevator cab relative to the rods; and a pantograph linkage coupled to the first elevator cab and the second elevator cab, wherein the at least one linear actuator selectively causes expansion or contraction of the pantograph linkage to cause a change in a distance between the first elevator cab and the second elevator cab, a load of the second elevator cab is supported by the pantograph linkage, the rods respectively comprise a stop surface near a bottom of the rod, the second elevator cab includes a plurality of catches, and the catches are situated to contact respective stop surfaces when the second elevator cab moves a predetermined distance beneath the first elevator cab.

2. The elevator assembly of claim 1, wherein the at least one linear actuator comprises at least one rotatable shaft aligned with the mid-beam.

3. The elevator assembly of claim 2, wherein the at least one linear actuator comprises at least one of a worm gear device, a ball screw device, a roller screw device, a lead screw device, and a jack screw device.

4. The elevator assembly of claim 1, wherein the pantograph linkage comprises a plurality of links and a plurality of pivots that allow the links to move relative to each other;

the at least one linear actuator includes at least one rotatable shaft aligned with the mid-beam;

at least two of the links or at least two of the pivots are operatively engaged with the shaft;

rotary movement of the shaft causes the links to move relative to each other; and movement of the links relative to each other causes the second elevator cab to move vertically relative to the first elevator cab.

5. The elevator assembly of claim 4, wherein the rods remain in a fixed position relative to the first elevator cab; and the second elevator cab is configured to move relative to the rods during vertical movement of the second elevator cab relative to the first elevator cab.

6. The elevator assembly of claim 1, comprising a roping arrangement secured to the header beam, and wherein the second elevator cab is suspended beneath the first elevator cab; and the roping arrangement is configured to support a load of the first elevator cab and a load of the second elevator cab.

7. An elevator assembly, comprising:

a header beam;

a first elevator cab supported by the header beam;

a plurality of vertically oriented rods extending beneath the first elevator cab;

a horizontally oriented mid-beam coupled to a first one of the rods near a first end of the mid-beam and coupled to a second one of the rods near a second end of the mid-beam;

a second elevator cab situated beneath the first elevator cab and beneath the mid-beam;

at least one linear actuator supported at least partially on the mid-beam, the linear actuator selectively causing vertical movement of the second elevator cab relative to the rods; and a pantograph linkage coupled to the first elevator cab and the second elevator cab, wherein the at least one linear actuator selectively causes expansion or contraction of the pantograph linkage to cause a change in a distance between the first elevator cab and the second elevator cab, the pantograph linkage comprises a plurality of links and a plurality of pivots that allow the links to move relative to each other, the at least one linear actuator includes at least one rotatable shaft aligned with the mid-beam, at least two of the links or at least two of the pivots are operatively engaged with the shaft, rotary movement of the shaft causes the links to move relative to each other, and movement of the links relative to each other causes the second elevator cab to move vertically relative to the first elevator cab.

8. The elevator assembly of claim 7, wherein the at least one linear actuator comprises at least one rotatable shaft aligned with the mid-beam.

9. The elevator assembly of claim 8, wherein the at least one linear actuator comprises at least one of a worm gear device, a ball screw device, a roller screw device, a lead screw device, and a jack screw device.

10. The elevator assembly of claim 7, wherein a load of the second elevator cab is supported by the pantograph linkage;

the rods respectively comprise a stop surface near a bottom of the rod;

the second elevator cab includes a plurality of catches; and the catches are situated to contact respective stop surfaces when the second elevator cab moves a predetermined distance beneath the first elevator cab.

11. The elevator assembly of claim 7, wherein the rods remain in a fixed position relative to the first elevator cab; and the second elevator cab is configured to move relative to the rods during vertical movement of the second elevator cab relative to the first elevator cab.

12. The elevator assembly of claim 7, comprising a roping arrangement secured to the header beam, and wherein the second elevator cab is suspended beneath the first elevator cab; and the roping arrangement is configured to support a load of the first elevator cab and a load of the second elevator cab.

* * * * *